US007458651B1

(12) United States Patent
Radke et al.

(10) Patent No.: US 7,458,651 B1
(45) Date of Patent: Dec. 2, 2008

(54) DRAWER SLIDE WITH ADJUSTABLE STRIKE

(75) Inventors: Todd F. Radke, Chico, CA (US); James Henderson, Chico, CA (US)

(73) Assignee: ATC Hardware Systems, Inc., Chico, CA (US)

( * ) Notice: Subject to any disclaimer, the term of this patent is extended or adjusted under 35 U.S.C. 154(b) by 87 days.

(21) Appl. No.: 11/557,816

(22) Filed: Nov. 8, 2006

(51) Int. Cl.
*A47B 88/04* (2006.01)

(52) U.S. Cl. ..... 312/333; 312/334.46

(58) Field of Classification Search ..... 312/330.1, 312/333, 334.1, 334.7, 334.8, 334.44, 334.46; 384/21

See application file for complete search history.

(56) References Cited

U.S. PATENT DOCUMENTS 4,469,384 A * 9/1984 Fler et al. ..... 312/333
5,757,109 A * 5/1998 Parvin ..... 312/334.11
6,155,661 A * 12/2000 O'Neil et al. ..... 312/334.44
6,244,678 B1 * 6/2001 Dopp et al. ..... 312/333
6,450,600 B1 * 9/2002 Chen et al. ..... 312/334.46
6,685,288 B1 * 2/2004 MacMillan ..... 312/334.46

* cited by examiner

*Primary Examiner*—James O Hansen
(74) *Attorney, Agent, or Firm*—William Bodnar

(57) ABSTRACT

The present invention relates to a drawer slide assembly with an integral strike and catch mechanism to inhibit inadvertent opening of a drawer. The structure of the present invention comprises at least two drawer slide members slidably engaged. One slide member includes an adjustable strike and another slide member includes a catch. The strike and catch engage when the drawer is closed and thus prevent inadvertent opening of the drawer. A strike fastener allows for quick and effective adjustment of the strike position which partially determines the pull force necessary to open the drawer.

16 Claims, 5 Drawing Sheets

DRAWER SLIDE WITH ADJUSTABLE STRIKE

CROSS REFERENCE TO RELATED APPLICATIONS

None.

FIELD OF THE INVENTION

The present invention relates to the field of drawer slides of the type used in cabinetry. More specifically the present invention relates to drawer slides that are adapted to prevent the drawer from unintentionally opening.

BACKGROUND OF THE INVENTION

Drawer slides are designed to function with a minimum amount of friction as a drawer is opened and closed. Such operation allows drawers to be opened and closed with minimal effort. Unfortunately, this has resulted in a situation where drawers sometimes open when they are not intended to open. This phenomenon is especially prevalent in cabinetry designed for mobile applications such as recreational vehicles (RVs), boats or other travel vehicles. Specifically, as the vehicles and the cabinetry are moved the drawers tend to open. Unintentional and unwanted opening can also occur if the vehicle and/or drawer cabinets are not level.

Previous attempts to solve the problem of unintentional drawer opening have themselves had limitations. Limitations include—relatively low resistance to drawer opening, structures that require a large amount of space, moving catches that are subject to wear and breakage and complex structures that add significantly to assembly and material cost. In addition, some devices actually limit the dimensions of the functional drawer assembly itself.

There remains a need for a drawer slide that can reliably and economically keep a drawer from unintentionally opening and function in mobile applications as well as in conventional building applications.

SUMMARY OF THE INVENTION

The present invention relates to a drawer slide assembly with an integral catch mechanism to inhibit inadvertent opening of a drawer. The structure of the present invention comprises an outer slide member and an inner slide member. The inner slide member is slideably engaged to the outer slide member. The structure includes a catch comprised of a protuberance in one of the slide members. A strike mechanism is positioned on a different slide member to engage the catch when the drawer slide assembly is in the closed position. The strike includes a strike arm that is resiliently seated over the catch to hold the slide members in a fixed position when a drawer is closed.

The strike mechanism is provided with adjustment means to set the strike arm vertical contact position with the catch. The force necessary to disengage the strike and catch is partially dependant upon the vertical position set via the adjustment means. The weight due to the contents of a particular drawer as well as the size and depth of the drawer also has an effect on the force necessary to keep the drawer closed.

There are many advantages of embodiments of the present invention. Specifically examples of the present invention provide a simple and effective mechanism for the prevention of unintentional opening of drawers. Therefore, cabinetry can be utilized in mobile applications without the inconvenience and danger of a drawer sliding open, while, at the same time eliminating the need to latch and unlatch a cumbersome mechanism.

It is a further advantage of examples of the present invention to provide a strike and catch that secures a drawer merely by closing the drawer in a traditional manner and applying the necessary force. Therefore, there is little extra effort needed to secure the drawer in a closed position. There is also no need to purchase and install secondary latch mechanisms.

Examples of the present invention also provide a convenient method of adjusting the force necessary to keep a drawer closed. These examples provide a drawer slide assembly with an integral strike and catch mechanism that will prevent unintentional and undesired opening of drawers when cabinetry is positioned on an uneven surface or the drawer slides are not mounted level.

The drawer slide assembly disclosed utilizes an integral strike and catch that can be effective in both two-member and three-member drawer slides. These and other advantages of examples of the present invention will become evident from the following detailed descriptions.

BRIEF DESCRIPTION OF DRAWINGS

The character of the invention, however, may be best understood by reference to one of its structural forms as illustrated by the accompanying drawings, in which.

DETAILED DESCRIPTION OF DRAWINGS

Figure 1:
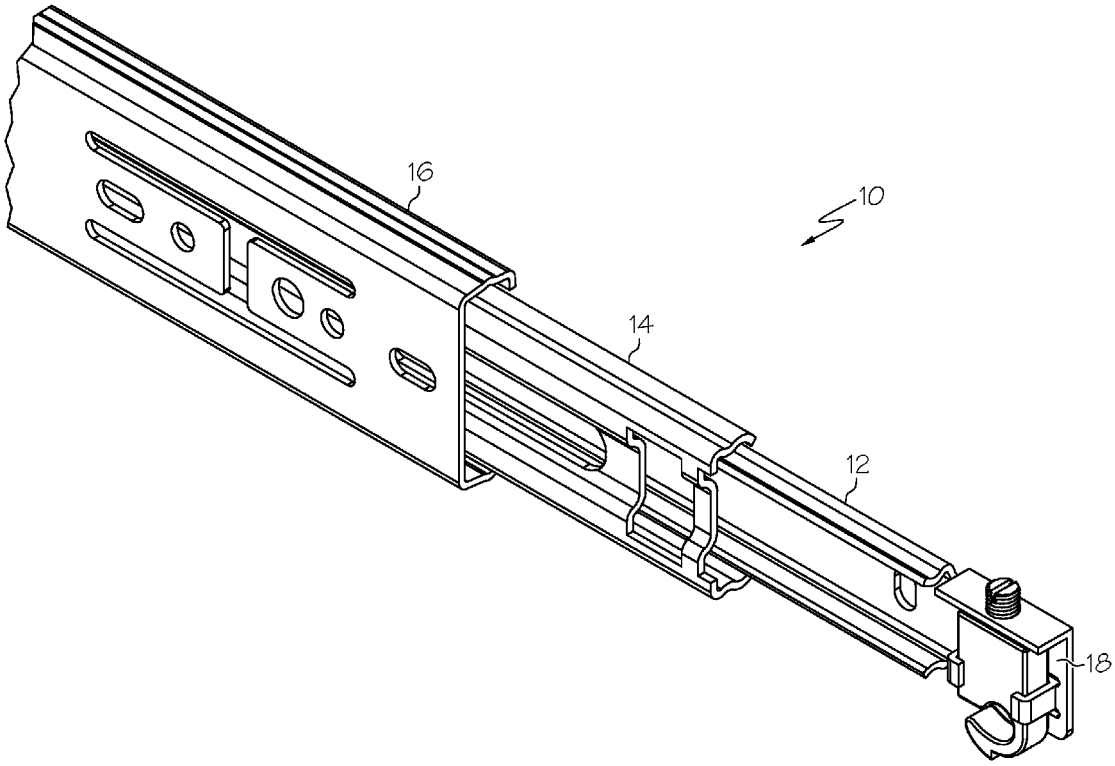
FIG. 1 is a perspective view of a left side drawer slide with an adjustable strike mechanism.

Referring to FIG. 1, which shows the general features of an example of the invention, a perspective view of a left side drawer slide 10 is shown. As illustrated, the drawer slide consists of an inner member 12, and intermediate member 14, and an outer member 16. An adjustable strike mechanism 18 is shown mounted to the front of the inner member 12.

Figure 2:
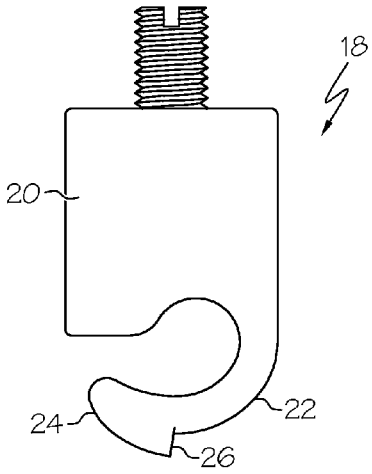
FIG. 2 is a side view of an adjustable strike.
Figure 3:
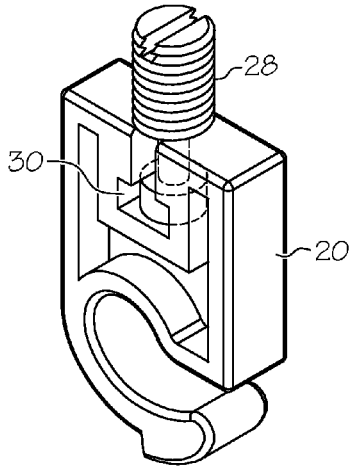
FIG. 3 is a perspective view of an adjustable strike.

FIG. 2 shows a side view of an adjustable strike mechanism 18. Components of the strike mechanism include a strike body 20, a strike arm 22, a strike arm head, and a strike arm step 26. FIG. 3 is a perspective view of an adjustable strike mechanism showing a shoulder screw 28 and a screw saddle 30 in the strike body 20.

Figure 4:
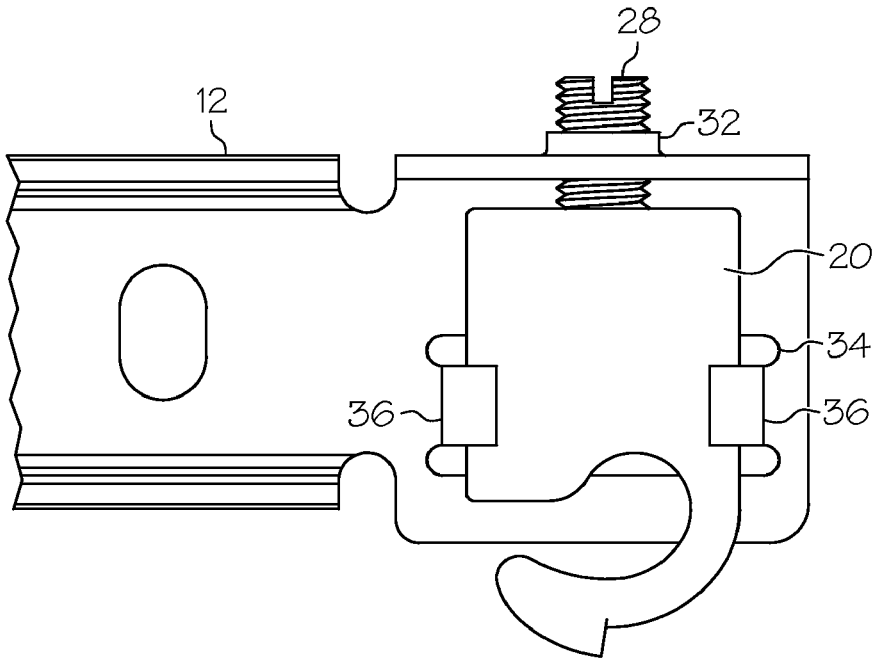
FIG. 4 is a side view of an adjustable strike mechanism mounted to an inner rail of a drawer slide.

FIG. 4 is a side view an adjustable strike mechanism mounted on the inner slide member 12 of a drawer slide. The strike body 20 is enclosed within a strike housing 34 which includes two flanges 36. The strike housing flanges are normally stamped-out sections of the drawer slide but other methods and components can comprise the flange(s). The strike mechanism is further secured to the inner slide member 12 by a screw 28 engaged with the top of the inner slide member and a threaded drawn hole flange 32.

Figure 5:
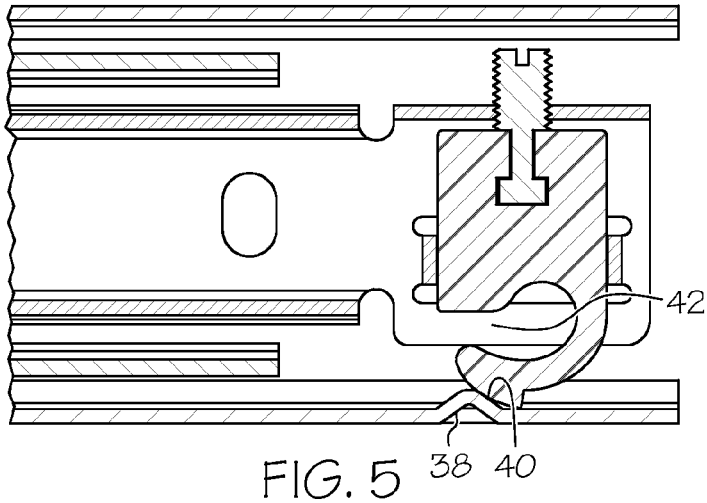
FIG. 5 is a side view of a drawer slide with the head of the strike arm in contact position with the catch.
Figure 6:
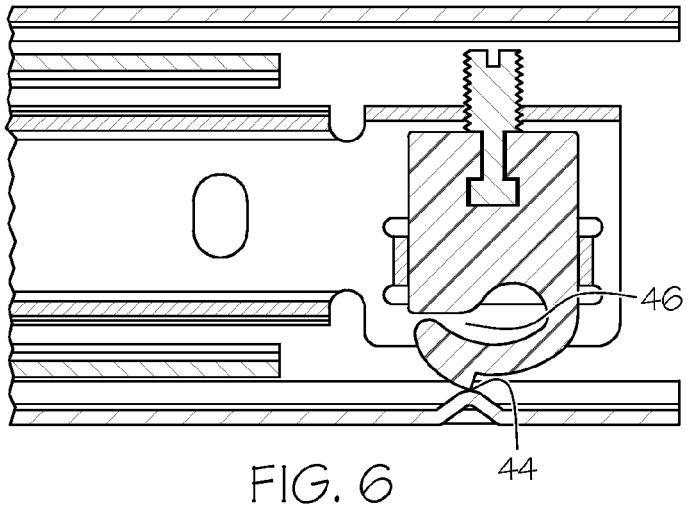
FIG. 6 is a side view of a drawer slide with the strike arm head in further contact position with the catch.
Figure 7:
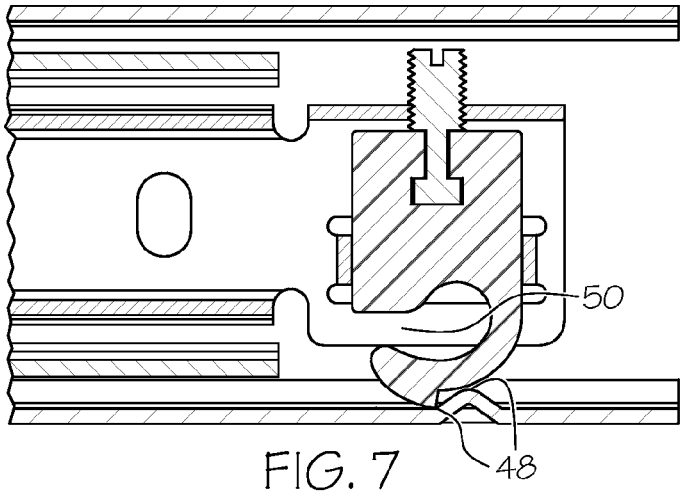
FIG. 7 is a view of a drawer slide with the strike in engagement position with the catch.

FIGS. 5, 6 and 7 show side views of an adjustable strike mechanism at various telescoping positions in relation to the outer slide member and the catch 38 as a drawer is closed. In FIG. 5 the strike arm head is shown making contact 40 with the catch 38 in this initial position. At the screw setting illustrated, the strike arm contacts the catch approximately at the midpoint of the strike arm head. Note that the distance 42 between the top of the strike arm head and the strike body is greatest at this point.

The screw setting controls the position of contact between the strike arm head and the catch. The vertical force due to the strike arm configuration is greater when the strike arm contacts the catch at or neat the top of the strike arm head. The vertical strike arm force is less when the strike arm contacts the catch near the bottom of the strike arm head (near the strike arm step). The setting illustrated in FIG. 5 would result in an average vertical holding force because the contact point with the catch is approximately halfway up the head of the strike arm. There is also a friction force at the point of contact. This force is minimized during drawer closing by the curved shape of the strike arm head and the flexibility of the strike arm itself.

As the drawer is closed further as illustrated in FIG. 6, the strike arm head slides along the top of the catch to achieve a contact position 44 just prior to full engagement. At this position the distance 46 between the top of the strike arm head and the strike body is much less than in FIG. 5.

The drawer is fully closed in FIG. 7 and the strike arm is fully engaged with the catch. The strike arm step is seated against the back side of the catch. In this position the distance 50 between the top of the strike arm head and the strike body is greater than as shown in FIG. 6 indicating the vertical force exerted by the strike arm on the catch has decreased. As seen in FIG. 7, there can be one or more contact points 48 for the strike arm and the catch.

Figure 8:
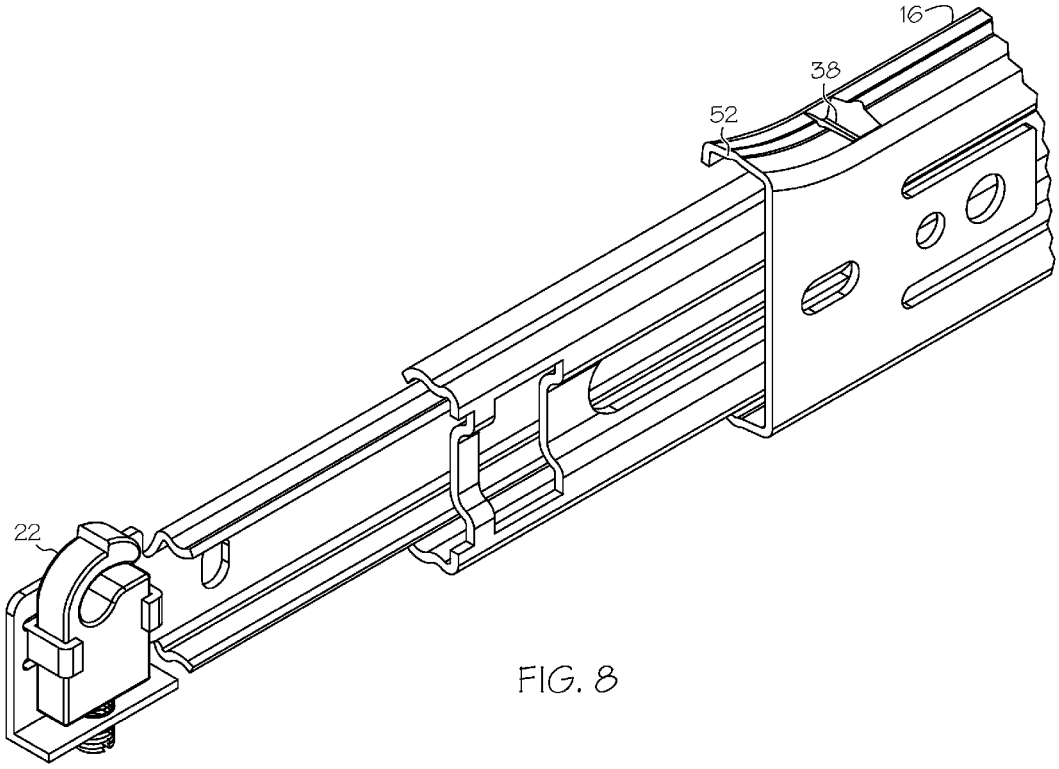
FIG. 8 is a perspective view of a right side drawer slide with an adjustable strike.

A perspective view of a right side drawer slide is shown in FIG. 8. The drawer slides with adjustable strike mechanisms illustrated are non-handed meaning the same drawer slide can be used for the left side or right side of a drawer. If the drawer slide is utilized on the left side, the strike arm will be oriented towards the bottom of the drawer (see FIG. 1). A drawer slide utilized on the right side would have a strike arm 22 oriented towards the top of a drawer as shown in FIG. 8. However, both handed and non-handed applications are envisioned. Handed adaptations would mean that there would be a designated left and right side member. The orientation of the strike arm could be either upwards or downwards.

A modification to the edge 52 of the channel of the outer slide member 16 is also shown in FIG. 8. Here the edge 52 of the channel is bent upwards slightly to create a ramp leading up to the catch. This helps minimize contact and friction between the strike arm head and the edge of the outer slide member upon drawer closing.

To open the drawer, a pull force must be exerted horizontal to the plane of the slides. Several forces are acting counter to the pull force to keep the drawer closed. There is a friction force and engagement force exerted by the strike arm against the catch. A horizontal force is exerted by at least one strike flange arm to counter horizontal movement of the strike body itself. There is the deflection force of the strike arm resisting the tendency of the strike arm to deflect vertically. And there is also a holding force transmitted through the screw and the strike body that resists vertical displacement.

CONCLUSIONS AND SCOPE OF INVENTION

In summary, an example of a slide with adjustable strike described herein provides a unique mechanism to secure a drawer in place to prevent inadvertent opening. This mechanism is easy to install, sturdy, durable and above all, easily adjustable. Prospective applications of this invention are numerous. Drawer slides are used in a variety of installations and the popularity of roll out shelves continues to grow. And, while specific examples of slides with an adjustable strike have been described, other examples and component modifications are envisioned.

The materials utilized for the slide members described herein are typically metal. The catch illustrated can be created by stamping or forming an indentation in the appropriate slide member. The strike body is typically made of high density plastics, polymers and/or synthetic materials. Any type of rigid material suitable for use in cabinetry applications is considered within the scope of the slide with adjustable strike and can be utilized for the strike body. The strike body could also be manufactured by utilizing a combination of metal and non-metal components.

The adjustable fastener illustrated herein is a metal screw fit into a hollowed out section (or saddle) of the strike body. Specifically a shoulder screw is illustrated with the bottom of the shoulder screw fitting into the saddle and thus fixing the movement of the strike body in relation to the movement of the screw. Any suitable fastener can be utilized to secure the strike body to the appropriate slide member while allowing for adjustment.

The fastener (screw) illustrated is threaded through a drawn hole in the inner slide member. A drawn hole creates a flange section which allows the threaded portion of a fastener or screw to have more contact area and thus greater fastening and adjusting capabilities. The threaded drawn hole also further serves as support for the strike body.

Another desirable feature shown in the illustrated examples is the ease of adjustment of the fastener. The fastener can be located at the front of the drawer slide to provide easy access to the adjustment means. In addition, the placement of the strike at the end of a telescoping member allows full use and extension of the drawer slide members.

The strike arm is designed to offer flexibility, strength and durability. The strike arm can be formed by machining or removing stock from the strike body. The unique arcuate shape of the strike arm allows for flexibility while still proving strength and durability.

The strike arm and strike body illustrated are one piece. The strike arm could be manufactured separately from the strike body as long as the two (or more) components were securely attached. It is also contemplated that the strike arm and strike body could be manufactured utilizing different materials to provide maximum strength, durability and flexibility. In another example, a strip of metal could be placed or imbedded into a polymer to provide greater durability and flexibility.

The strike body and strike arm are designed to resist a horizontal pull force of between 0.1 and 25 lbs. for a typical installation. This would correspond to resisting a pull force of between 0.4 and 111.2 Newtons (N). The shape and materials utilized for the strike, catch and/or slide members could also be modified to resist a much greater pull force. Drawer slides with adjustable strikes capable of resisting pull forces of 100 lbs. or more are contemplated.

Other examples of the invention will be apparent to those skilled in the art from a consideration of the specification or practice of the invention disclosed herein. It should be evident that this disclosure is by way of example and that various changes may be made by adding, modifying, or eliminating details without departing from the fair scope of the teaching contained in this disclosure. The invention is therefore not limited to particular details of this disclosure except to the extent that the following claims are necessarily so limited. Thus it is intended that the specification and examples be considered as illustrative only, with the true scope and spirit of the invention being indicated by the following claims.

What is claimed is:

1. A drawer slide comprising:

outer, intermediate and inner telescoping slide members for slidable attachment of a drawer to a cabinet case, said slide members each having a longitudinal planar span and longitudinal opposed channels extending in a longitudinal telescoping direction, the channels of the outer slide member slidably cooperative with the channels of the intermediate slide member, the channels of the intermediate slide member slidably cooperative with the channels of the inner slide member, a mechanism for releasably maintaining the slide members in a fixed closed telescoping condition, said mechanism comprising:

a strike adjustably connected to said inner slide member, a catch positioned on one of said channels of said outer slide member, said strike comprising a strike body and a strike arm connected to said strike body, wherein said strike arm extends beyond a periphery of said opposed channels of said inner slide member, and said catch comprising a protuberance within the one of said channels to engage said strike arm.

2. The drawer slide of claim 1 wherein said strike body comprises a strike saddle to accommodate a fastener to provide adjustment for said strike.

3. The drawer slide of claim 2 wherein said strike body is connected to said inner slide member through a strike housing.

4. The drawer slide of claim 3 wherein said strike housing comprises at least one flange.

5. The drawer slide of claim 1 wherein said inner slide member further comprises a threaded aperture to accommodate a fastener to provide adjustment for said strike.

6. The drawer slide of claim 5 wherein said strike body is adjustably attached to said inner slide member by use of said fastener.

7. The drawer slide of claim 6 wherein said fastener is a screw.

8. The drawer slide of claim 7 wherein said fastener is a shoulder screw.

9. The drawer slide of claim 1 wherein a closed drawer utilizing two of said drawer slides will resist a pull force of 0.1 to 25 pounds.

10. The drawer slide of claim 1 wherein said strike body is at least partially comprised of a polymer.

11. The drawer slide of claim 1 wherein said strike body is at least partially comprised of metal.

12. The drawer slide of claim 1 wherein said strike arm is at least partially comprised of a polymer.

13. The drawer slide of claim 1 wherein said strike arm is at least partially comprised of metal.

14. The drawer slide of claim 1 wherein the shape of said strike arm is arcuate.

15. The drawer slide of claim 1 wherein an end of the one of said channels of said outer slide member has an arcuate configuration to facilitate access of said strike arm to said protuberance.

16. The drawer slide of claim 1 wherein a closed drawer utilizing two of said drawer slides will resist a pull force of 0.1 to 100 pounds.

* * * * *